United States Patent [19]

Sammaratano

[11] Patent Number: 4,753,126

[45] Date of Patent: Jun. 28, 1988

[54] RANGE OF MOTION LIMITING DEVICE

[75] Inventor: Arthur Sammaratano, Centereach, N.Y.

[73] Assignee: Lumex, Inc., Bay Shore, N.Y.

[21] Appl. No.: 802,578

[22] Filed: Nov. 27, 1985

[51] Int. Cl.[4] ..... G05G 1/04; A47B 36/06; E04G 3/00; A63B 21/22

[52] U.S. Cl. ..... 74/526; 272/131; 272/134; 248/230

[58] Field of Search ..... 74/526, 437; 248/230, 248/231, 231.1–231.6; 272/134, 130, 131, 132

[56] References Cited

U.S. PATENT DOCUMENTS

| | | | |
|---|---|---|---|
| 1,004,388 | 9/1911 | Dickert . | |
| 1,290,126 | 1/1919 | Drake . | |
| 1,352,659 | 9/1920 | Drake . | |
| 1,366,991 | 2/1921 | Williams . | |
| 1,587,983 | 6/1926 | Olson . | |
| 2,855,199 | 10/1958 | Noland . | |
| 3,640,498 | 2/1972 | Aleks | 248/230 |
| 3,706,437 | 12/1972 | Eberhardt | 248/230 |
| 3,752,144 | 8/1973 | Weigle . | |
| 3,998,562 | 12/1976 | Gostling | 248/230 |
| 4,169,589 | 10/1979 | McArthur . | |
| 4,311,305 | 1/1982 | Lambert et al. | 272/134 |
| 4,338,875 | 7/1982 | Lisowski | 248/230 |
| 4,349,195 | 9/1982 | Johnston . | |
| 4,408,759 | 10/1983 | Reneau et al. | 272/131 |
| 4,470,596 | 9/1984 | Desiderio | 272/134 |
| 4,492,236 | 1/1985 | Pile . | |
| 4,492,375 | 1/1985 | Connelly . | |
| 4,501,168 | 2/1985 | Chaulk . | |
| 4,632,393 | 12/1986 | Van Noord | 272/134 |

FOREIGN PATENT DOCUMENTS

| | | | |
|---|---|---|---|
| 828366 | 1/1952 | Fed. Rep. of Germany . | |
| 2554195 | 5/1985 | France | 272/134 |
| 8602848 | 5/1986 | PCT Int'l Appl. | 272/134 |

OTHER PUBLICATIONS

Athletic Journal, vol. 55, No. 4, Dec., 1974, pp. 15, 26, 28, 30, 31 and 77–80.

*Primary Examiner*—Gary L. Smith
*Assistant Examiner*—Vinh Luong
*Attorney, Agent, or Firm*—Davis, Hoxie, Faithfull & Hapgood

[57] ABSTRACT

A range of motion limiting device for limiting the range of motion of a rotating input assembly on a trunk extension/flexion test, rehabilitation and exercise machine. The device has a cam lock and a cam lock housing, each of which is one integral piece. The cam lock has a cylindrical cam base, a cam extending from the cam base, an L-shaped tongue and a bracket. A shock absorber is mounted in the bracket. The cam lock housing has a locking knob thread for a locking knob, an L-shaped groove into which the L-shaped tongue of the cam lock fits when the device is assembled, an elongated hole for receiving the cam and cam base of the cam lock, and a ring clamp groove which nests around a semi-circular ring which is mounted on the machine. The device is assembled by inserting the cam and cam base into the elongated hole of the cam lock housing and rotating the cam lock relative to the cam lock housing to a final assembled position. The device is then slid onto one end of the semi-circular ring and secured on the ring by turning in the locking knob. When an input assembly of the machine hits the shock absorber, the cam rotates against an inside diameter of the semi-circular ring firmly securing the device on the semi-circular ring and stopping the rotary motion of the input assembly.

21 Claims, 7 Drawing Sheets

RANGE OF MOTION LIMITING DEVICE

FIELD OF THE INVENTION

This invention relates to a range of motion limiting device for limiting the range motion of a rotating member, particularly for limiting the range of motion of a rotating input assembly on a test, rehabilitation and exercise machine.

BACKGROUND OF THE INVENTION

For test, rehabilitation and exercise machines where rotary motion of a person's musculature is involved, it is important to be able to limit the range of rotary motion so that injury does not result from over rotation. Also, for the effective rehabilitation of certain musculature over a certain specified range of rotary motion, for example trunk musculature involved in trunk extension and flexion, it is important to limit the range of rotary motion so that the rehabilitation can be focussed on that part of the range of rotary motion which needs the rehabilitation.

In a test, rehabilitation and exercise machine which permits a person to engage in trunk extension and trunk flexion movement, it is often necessary to limit how far the person extends the trunk or flexes the trunk. If a person has only a limited ability to extend his or her trunk (i.e., bend backward at the waist), or flex his or her trunk (i.e., bend forward at the waist), trunk extension or flexion beyond a certain point in the rotary motion could very well cause serious injury to the back. The value of a trunk extension/flexion test, rehabilitation and exercise machine is severely diminished if no provision is made for limiting the range of rotary motion.

Also, the means for limiting the range of rotary motion must be adjustable to any position along the range of motion, so that the trunk extension/flexion machine can be used with a wide variety of persons with different range of rotary motion limitations.

Further, the adjustment of where the range of rotary motion is to be limited must be quick and easy to accomplish, so that persons with different range of rotary motion limitations will not have to wait for treatment on the machine due to the delay caused by the adjustment.

Exemplary range of motion limiting apparatuses for limiting rotary motion on exercise machines are shown in U.S. Pat. Nos. 2,855,199 to Noland et al and 4,492,375 to Connelly. General range of motion limiting apparatuses for limiting rotary motion are shown in U.S. Pat. Nos. 3,505,884 to Ford et al and 1,004,388 to Dickert.

SUMMARY OF INVENTION

The present invention is for a range of motion limiting device for limiting the range of motion of a rotating member engaged in rotary motion. The present invention is also for apparatus for limiting the range of rotary motion of an input assembly on a test rehabilitation and exercise machine, in both directions of rotation.

The device of the present invention includes a one-piece cam lock having a cylindrical cam base and a cam extending from the cam base. The cam lock also has an L-shaped tongue and a bracket. Secured in the bracket is a shock absorber. The bracket is at a 45° angle relative to a side of the cam lock.

The device of the present invention also includes a cam lock housing with a ring clamp groove for nesting around a semi-circular ring.

The cam lock housing also has an elongated hole for receiving the cam and cam base of the cam lock. Also on the cam lock housing is an L-shaped groove into which the L-shaped tongue of the cam lock fits after the cam and cam base of the cam lock are received in the elongated hole of the cam lock housing.

Inserted in a thread in the cam lock housing is a locking knob for securing the device at any position on the semi-circular ring.

After the cam and cam base are received into the elongated hole and the L-shaped tongue fitted into the L-shaped groove, the device is slid onto an end of the semi-circular ring. Tightening the locking knob causes a locking knob base of the locking knob to press against an angled surface on the L-shaped tongue, forcing the cam lock to rotate relative to the cam lock housing. This rotation causes the cam to rotate against an inner diameter of the semi-circular ring, thus securing the device to the semi-circular ring.

When an impact block attached to the input assembly of the test, rehabilitation and exercise machine hits the shock absorber, the cam lock further rotates relative to the cam lock housing causing the cam to further rotate against the inside diameter of the circular ring. The device is now firmly secured to the semi-circular ring, and the rotary motion of the input assembly is stopped.

A surface of the ring clamp groove which nests against an outside diameter of the semi-circular ring has a sheet metal shoe rigidly attached thereto with carbarundum flame-sprayed on the sheet metal shoe. The carbarundum is rough and increases the holding friction force between the outside diameter of the circular ring and the cam lock housing.

One range of motion limiting device is used for limiting the range of motion of the input assembly of the test, rehabilitation and exercise machine for one direction of rotary movement. A second range of motion limiting device, configured in mirror image fashion to the first device, is used for limiting the rotary range of motion of the input assembly of the machine for a second direction of rotary movement.

BRIEF DESCRIPTION OF THE DRAWINGS

FIG. 10 shows the first range of motion limiting device positioned on a first end of the semi-circular ring and the second range of motion limiting device positioned on a second end of the semi-circular ring;

DETAILED DESCRIPTION OF THE INVENTION

Figure 1:
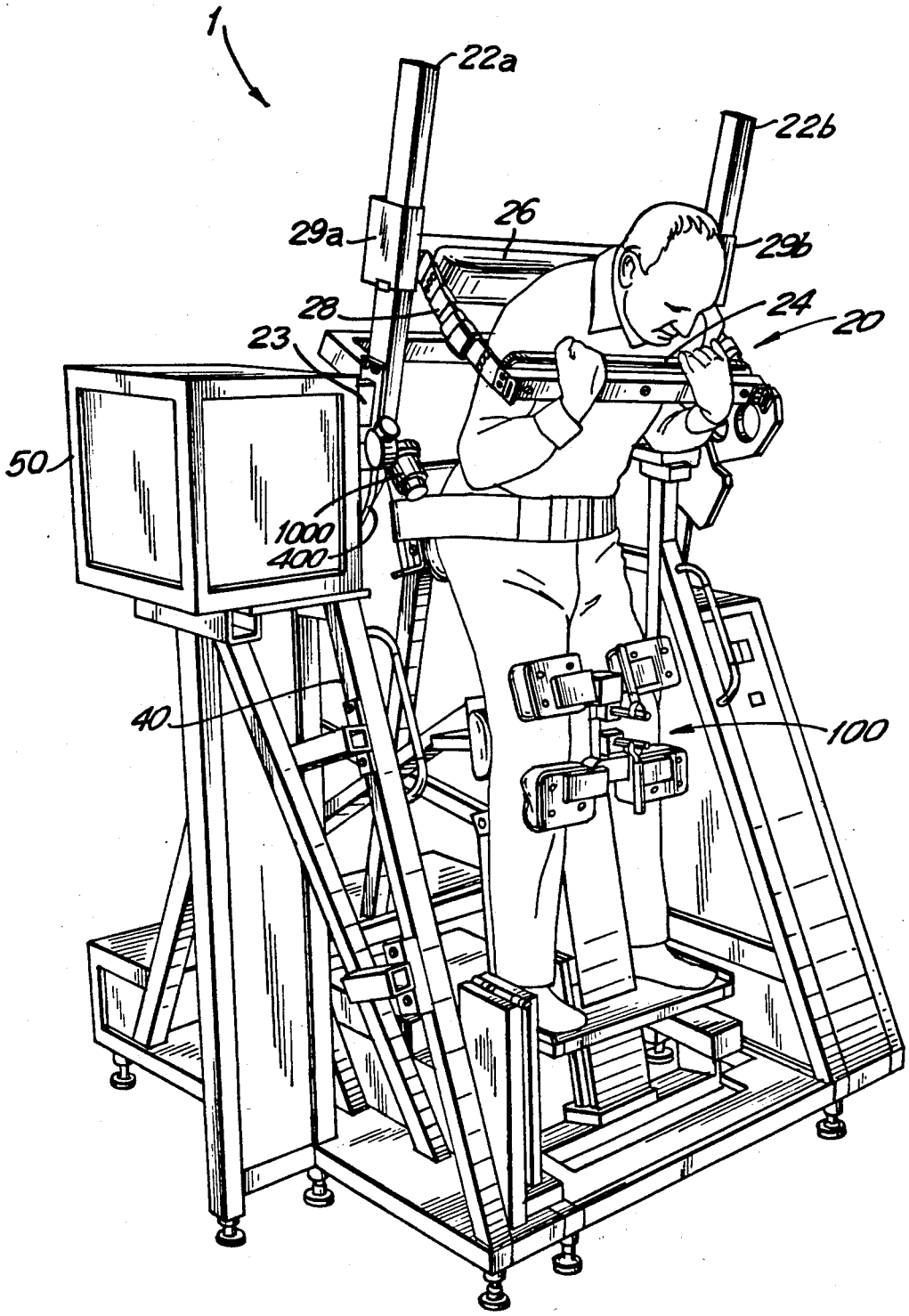
FIG. 1 is a perspective view of a trunk extension/-flexion test, rehabilitation and exercise machine which utilizes a range of motion limiting device of the present invention wherein a person who is secured in the machine is in a bent over or trunk flexion position.
Figure 2:
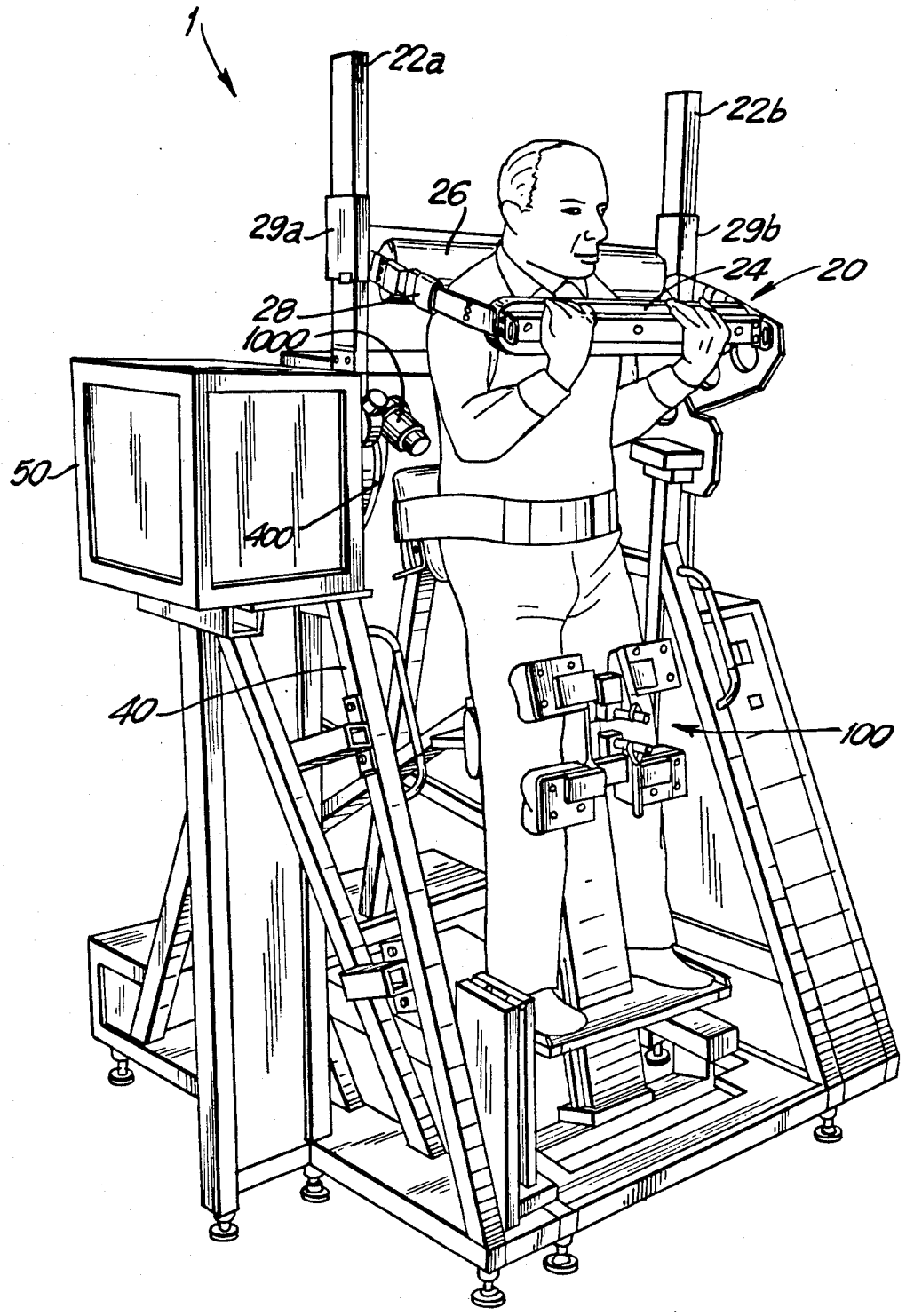
FIG. 2 is another perspective view of the trunk extension/flexion machine of FIG. 1 wherein the person is in a straight up or trunk extension position.

A trunk extension/flexion test, rehabilitation and exercise machine 1 which contains a range of motion limiting device 10 of the present invention is shown in FIGS. 1 and 2. The machine 1 is designed for the testing, rehabilitation and exercise of the trunk musculature used in trunk extension and trunk flexion movement. FIG. 1 shows a person secured to the machine 1 wherein the person is in the trunk flexion position. FIG. 2 shows the person secured to the machine 1 wherein the person is in the trunk extension position.

An input assembly 20 of the machine 1, which includes two input arms **22*a* and 22*b*, a chest pad 24 and a scapula pad 26, as shown in FIGS. 1 and 2, rotates downwardly when the person engages in trunk flexion movement and rotates upwardly when the person engages in trunk extension movement. A trunk flexion movement is movement from the position shown in FIG. 2 to the position shown in FIG. 1. A trunk extension movement is movement from the position shown in FIG. 1 to the position shown in FIG. 2**.

As seen in FIGS. 1 and 2, the chest pad 24 of the input assembly 20 bears against the chest of the person and the scapula pad 26 bears against the scapula. The chest pad 24 is attached to the scapula pad 26 by belts 28. The scapula pad 26 is attached to slide blocks **29*a* and 29*b* which slide over input arms 22*a* and 22*b* respectively. Slide blocks 29*a* and 29*b* are locked at any desired vertical position on input arms 22*a* and 22*b* using a suitable locking means such as toggle clamps (not shown). Attached to the input arm 22*a* is an impact block 23 which comes into contact with a range of motion limiting device 10** at some point in the trunk extension movement, as described below.

The input assembly 20 is rotatably attached to a frame 40 of the machine 1 such that the input assembly 20 will rotate upwardly in relation to the frame 40 when the person engages in trunk extension movement and well rotate downwardly in relation to the frame 40 when the person engages in trunk flexion movement.

An isokinetic dynamometer (not shown), which is mechanically connected to the input assembly 20, measures the force which the person is able to exert in trunk flexion movement and in trunk extension movement. The dynamometer operates on the well-known theory of isokinetics whereby the rotational speed of the input assembly 20 cannot exceed a pre-determined limit. The pre-determined rotational speed of the input assembly 20 is set by making a selection from dynamometer controls on the dynamometer.

The general theory of isokinetics is described in U.S. Pat. No. 3,465,592 issued to J. J. Perrine on Sept. 9, 1969. The description of isokinetics contained in that patent is incorporated herein by reference.

Until such time as the person exerts a force on the chest pad 24 or the scapula pad 26 sufficient to make the input assembly 20 rotate at the pre-determined speed, the person will not feel any resistive force. However, any attempt by the person to accelerate the input assembly 20 beyond the pre-determined speed results in the dynamometer providing an accommodating, resistive force equal to the force exerted by the person. Therefore, the person cannot make the input assembly 20 rotate any faster than the pre-determined speed, and any increased force exerted by the person is met by an equal accommodating, resistive force from the dynamometer.

The isokinetic dynamometer in the present embodiment is similar to the dynamometer which is available as part of the Cybex® II+test, rehabilitation and exercise machine, which is manufactured and sold by the Cybex Division of Lumex Inc., 2100 Smithtown Ave., Ronkonkoma, N.Y.

Since the dynamometer provides an accommodating, resistive force equal to the force exerted by the person, measurement of the force provided by the dynamometer is also a measurement of the strength of the person's trunk musculature through the trunk extension and trunk flexion movements. A computer (not shown) can be used to record this measurement and process a group of measurements for further analysis of the person's progress during the test, rehabilitation or exercise procedure.

In the present embodiment, the isokinetic dynamometer is located in a dynamometer enclosure 50. The dynamometer enclosure 50 is rigidly attached to the frame 40 of the machine 1.

During the test, rehabilitation or exercise procedure using the trunk extension/flexion machine 1, the legs of the person are stabilized against extraneous movement by a leg stabilization apparatus 100. The leg stabilization apparatus 100 is the subject of a copending application Ser. No. 06/802,523 filed on Nov. 28,1985 now U.S. Pat. No. 4,725,056 issued on Feb. 16, 1988 in the names of George Rehl, Howard Solow, entitled "Leg Stabilization Apparatus for a Trunk Extension/Flexion Test, Rehabilitation and Exercise Machine," filed concurrently herewith. The description contained in that application of the leg stabilization apparatus 100 is incorporated herein by reference.

Persons who are recovering from an accident, a back injury or the like often are limited in their ability to extend or flex their trunk musculature. Trunk extension or flexion beyond certain points in the range of motion could very well cause further injury to such persons. Therefore, it is important to be able to limit the range of motion of the input assembly 20, at any position along the range of trunk extension/flexion motion.

The range of motion limiting device 10 of the present invention is used to limit the trunk extension range of motion of the input assembly 20. A second range of motion limiting device 1000, which is configured in mirror image fashion to the range of motion limiting device 10, is used to limit the range of motion of trunk flexion of the input assembly 20.

The range of motion limiting device 10, once secured in position on the machine 1, prevents the input assembly 20 from rotating upwardly beyond a certain point. The point in the rotary motion where the range of motion limiting device 10 stops the upward rotation of the input assembly 20 is adjustable.

Similarly, the range of motion limiting device 1000 prevents the input assembly 20 from rotating downwardly beyond a certain point. As with the range of motion limiting device 10, the point in the rotary motion where the range of motion limiting device 1000 stops the downward rotation of the input assembly 20 is adjustable.

Figure 10:
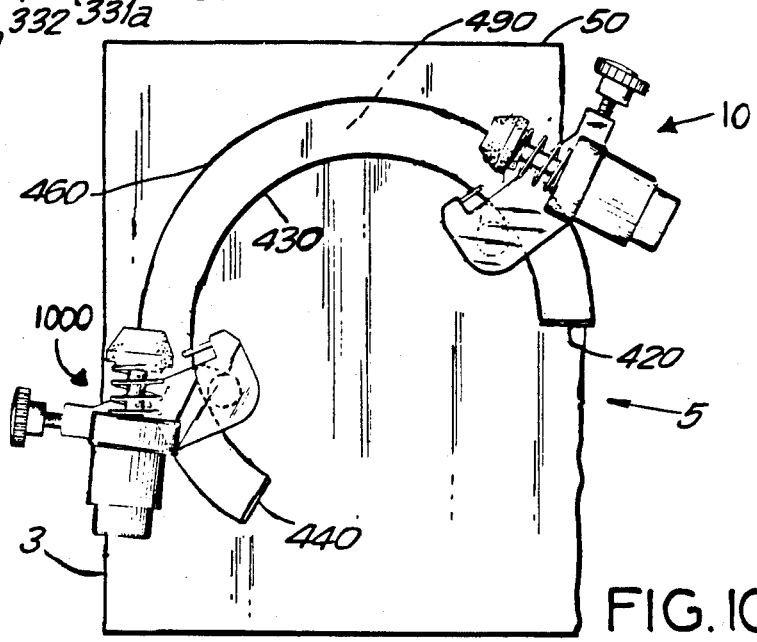
FIG. 10 is a simplified plan view, along the direction of the arrow in FIG. 1, of a semi-circular ring on which a first range of motion limiting device and/or second range of motion limiting device of the present invention may be positioned.

The range of motion limiting devices 10 and 1000 are each secured on a semi-circular ring 400. The semi-circular ring 400 is made of nodular iron in the present embodiment. The semi-circular ring 400, which is shown in FIG. 10, is rigidly attached to the frame 40 of the machine 1. For purposes of simplicity, the attachment of the semi-circular ring 400 to the frame 40 of the machine 1 is not shown in FIG. 10. However, any number of rigid attachment means such as bolts or screws would be suitable. In the present embodiment, bolts are used as the rigid attachment means.

The semi-circular ring 400 is attached to the frame 40 of the machine 1 parallel to the plane of rotation of the input assembly 20, so that one end 420 of the semi-circular ring 400 is toward the front 3 of the machine 1 and the other end 440 of the semi-circular ring 400 is toward the rear 5 of the machine 1 as shown in FIG. 10. The semi-circular ring 400 is attached to the frame 40 in such a manner that the range of motion limiting devices 10 and 1000 may slide onto the ends 420 and 440 of the semi-circular ring 400, respectively, as described below.

FIG. 10 shows the position of the semi-circular ring 400 in relation to the dynamometer enclosure 40. As seen in FIG. 10, the semi-circular ring 400 is positioned so that most of its circumference is toward the front 3 of the machine 1. This position is desirable because the human torso is able to flex (i.e., bend forward at the waist) much further than the torso is able to extend (i.e., bend backward at the waist).

Figure 11:
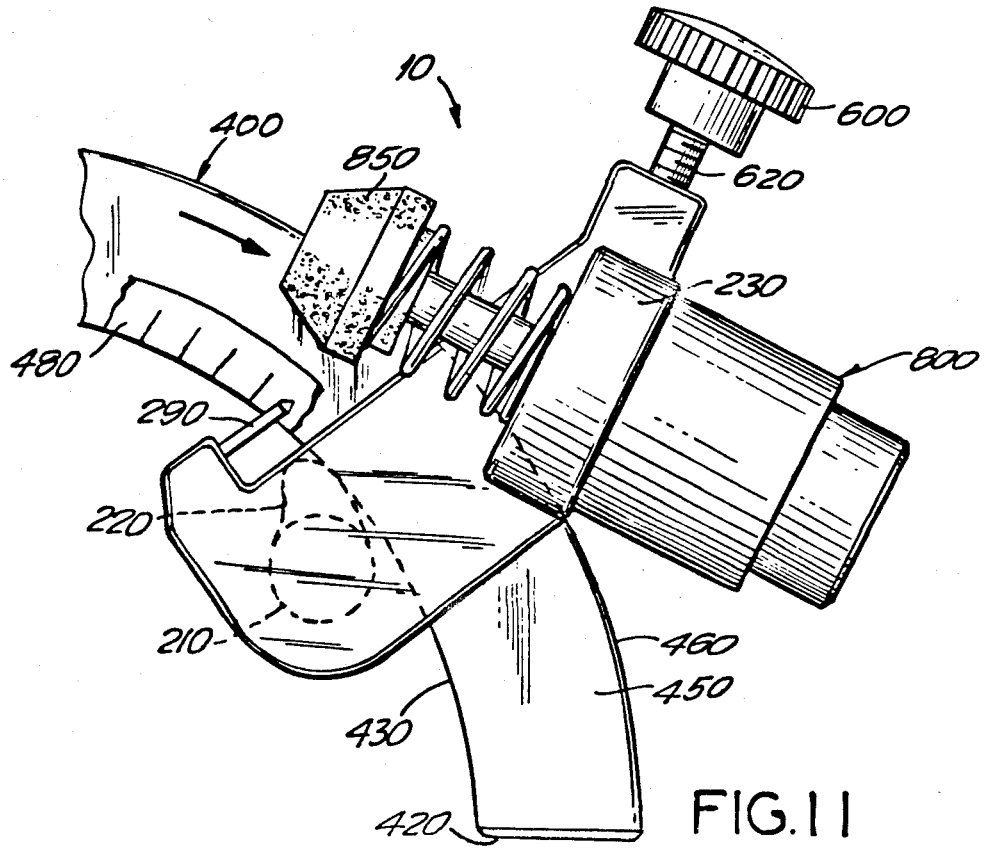
FIG. 11 is a plan view of a portion of the semi-circular ring of FIG. 10 with the range of motion limiting device of FIG. 3A secured on the semi-circular ring.

The range of motion limiting device 10 is secured to the semi-circular ring 400 by sliding the range of motion limiting device 10 onto the end 420 of the semi-circular ring 400 as shown in FIG. 11 and tightening a locking knob 600 as described below. The range of motion limiting device 1000 is likewise secured to the semi-circular ring 400 by sliding the range of motion limiting device 1000 onto the end 440 of the semi-circular ring 400 as shown in FIG. 12 and tightening a locking knob 6000.

For a better understanding of the range of motion limiting device 10 of the present invention, each part of the range of motion limiting device 10 is described below in conjunction with the drawings. The assembly of the range of motion limiting device 10 is then described, followed by a description of the operation of the range of motion limiting device 10 on machine 1 of FIGS. 1 and 2.

Figure 12:
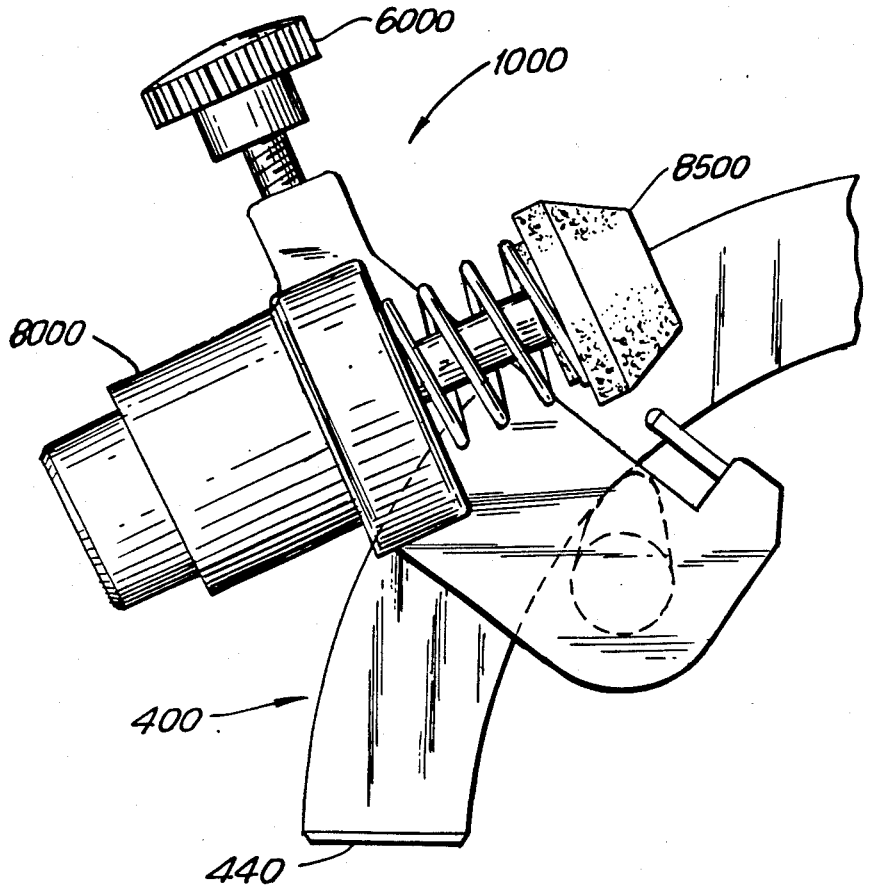
FIG. 12 is a plan view of another portion of the semi-circular ring of FIG. 10 with a second range of motion limiting device on the semi-circular ring.
Figure 13:
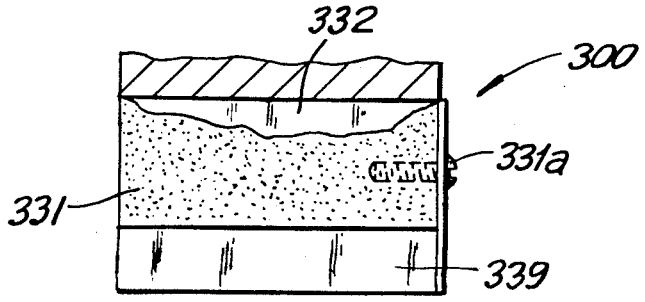
FIG. 13 is a partial view along lines c—c of FIG. 7 of a sheet metal shoe attached to a surface on the cam lock housing.

The range of motion limiting device 1000 is configured in mirror image fashion to the range of motion limiting device 10 as can be generally seem in FIGS. 11 and 12, and therefore no detailed description of the range of motion limiting device 1000 shall be given.

Figure 4:
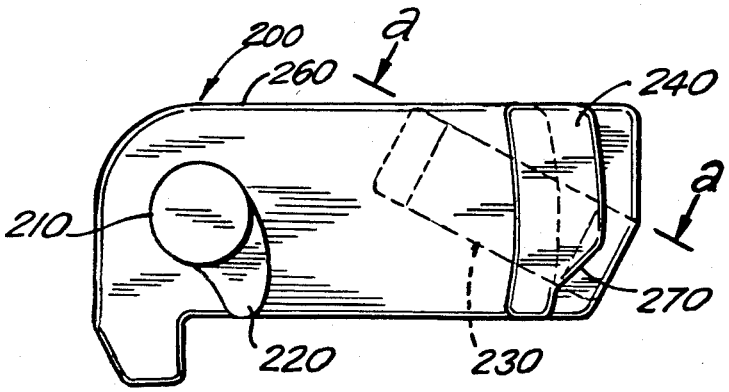
FIG. 4 a bottom view of a cam lock of the range of motion limiting device of the present invention.
Figure 5:
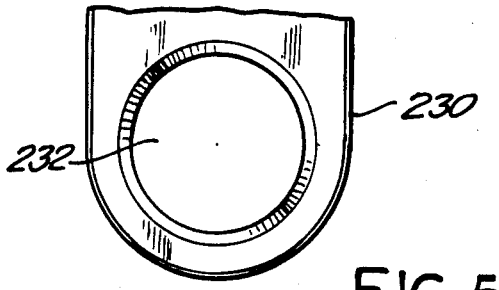
FIG. 5 is a side elevational view of a bracket of the cam lock along line a—a of FIG. 4.
Figure 6:
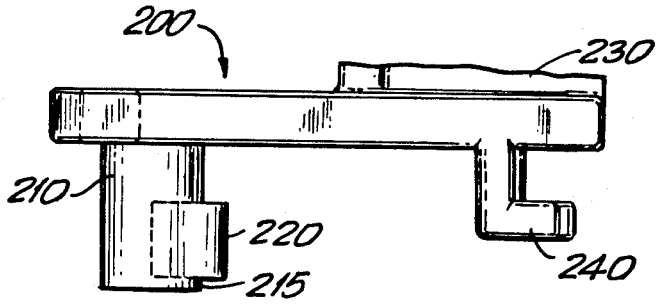
FIG. 6 a side elevational view of the cam lock of FIG. 4 except for the bracket.

A cam lock 200 of the range of motion limiting device 10 is shown in FIGS. 4, 5 and 6. The cam lock 200, in the present embodiment, is one integral piece and is heat treated 4130 alloy steel.

On the underside of the cam lock 200 is a solid cylindrical cam base 210. Extending from a bottom portion 215 of the cam base 210 is a solid cam 220. The cam base 210 and cam 220 are best seen in FIGS. 4 and 6.

The underside of the cam lock 200 also has an L-shaped tongue 240, shown in FIG. 6, which is designed to fit into a groove 320 of a cam lock housing 300, as described below.

Extending upwardly from the top of the cam lock 200 is a threaded bracket 230. The bracket 230, which may best be seen in FIG. 5, has a circular opening 232 into which a shock absorber 800 is secured. The shock absorber 800, shown in FIGS. 3, 3A, 3B, 11 and 12, in the present embodiment is a model SAS-3/4x.5-PS-CB manufactured by the EFDYN Corporation. The shock absorber 800 is secured to the bracket 230 by threading the shock absorber 800 into the bracket 230. In the present embodiment, the bracket 230 is at approximately a 45° angle relative to a side 260 of the cam lock 200.

Figure 7:
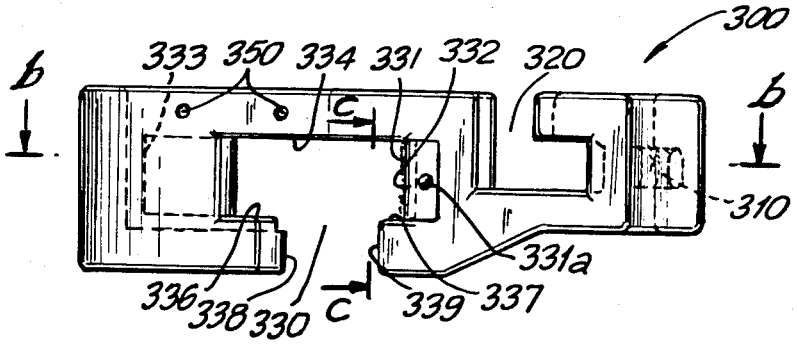
FIG. 7 is a side elevational view of a cam lock housing of the range of motion limiting device of the present invention.
Figure 8:
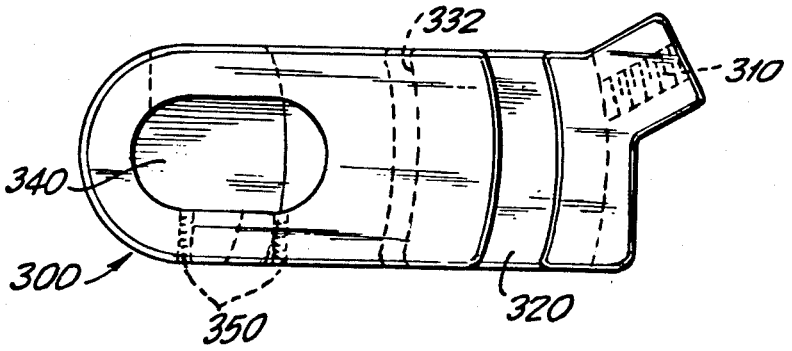
FIG. 8 is a top view of the cam lock housing of FIG. 7.
Figure 9:
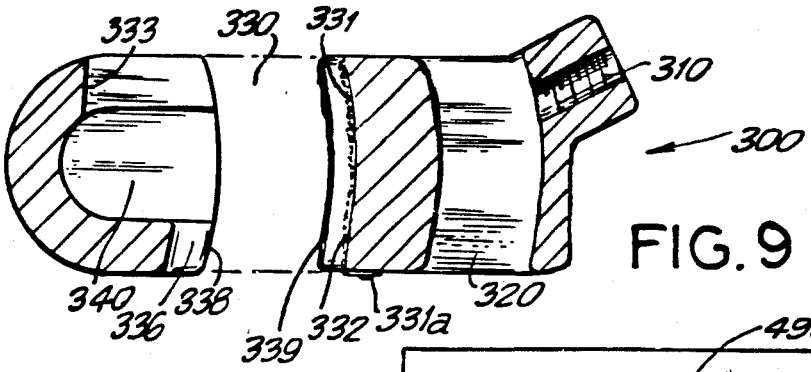
FIG. 9 is a cross-sectional view of the cam lock housing along lines b—b of FIG. 7.

The cam lock housing 300 of the range of motion limiting device 10 is shown in detail in FIGS. 7, 8, and 9. The cam lock housing, in the present embodiment, is one integral piece and is heat treated 4130 alloy steel.

The cam lock housing 300 has a locking knob thread 310 which is designed to receive a locking knob base 620 of a locking knob 600. The L-shaped groove 320, designed to receive the tongue 240 of the cam lock 200, is cut in the top of the cam lock housing 300 as shown in FIG. 7.

FIG. 7 also shows a ring clamp groove 330 cut in the bottom of the cam lock housing 300. The ring clamp groove is defined by surfaces 332, 333, 334, 336, 337, 338 and 339 of the cam lock housing 300 as shown in FIG. 7. The ring clamp groove 330 is designed to nest around the semi-circular ring 400 when an assembled range of motion limiting device 10, as shown in FIG. 3A, is slid onto the end 420 of the semi-circular ring 400, as shown in FIG. 11. The surface 332 nests on an outside diameter 460 of the semi-circular ring 400. The surface 334 nests on a top surface 450 of the semi-circular ring 440. Surfaces 336 and 337 nest on a bottom surface 470 of the semi-circular ring 400.

In order to increase the amount of friction between the outside diameter 460 of the semi-circular ring 400 and the surface 332 of the cam lock housing 300 so as to avoid any slippage, a sheet metal shoe 331 with a rough coating is rigidly attached to surface 332 by a screw **331*a* as shown in FIG. 7. In the present embodiment, carbarundum is flame sprayed on the surface of the sheet metal shoe 331**.

When the outside diameter 460 of the circular ring 400 is forced up against the sheet metal shoe 331 as described below, an increased friction between the outside diameter 460 of the semi-circular ring 400 and the carbarundum on the sheet metal shoe 331 results, and the range of motion limiting device 10 is held more securely on the semi-circular ring 400.

Through the top of the cam lock housing 300 is an elongated hole 340 designed to receive the cam base 210 and the cam 220 of the cam lock 200 for assembly of the range of motion limiting device 10.

The cam lock housing 300 also has two mountings 350 for mounting of a flat spring 700. The flat spring 700 is shown in FIGS. 3 and 3A, and described in more detail below.

The structure of the cam lock housing 300 may be further seen in FIG. 9, which is a cross-section view along lines b—b of FIG. 8. In FIG. 9 the hatched sections represent solid sections.

The range of motion limiting device 10 of the present invention is assembled in the following manner. First, the cam 220 and the cam base 210 of the cam lock 200 are inserted into the elongated hole 340 in the cam lock housing 300. FIG. 3 shows this initial assembled position of the range of motion limiting device 10 with the cam 220 and the cam base 210 inserted into the elongated hole 340 of the cam lock housing 300.

Figure 3:
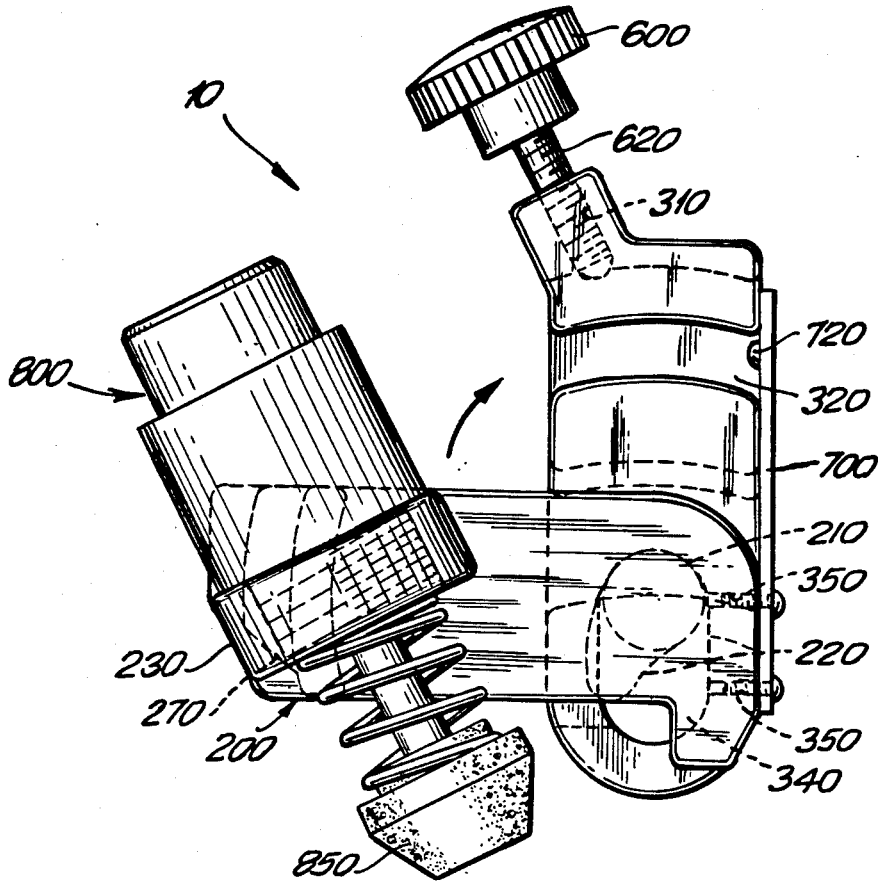
FIG. 3 is a plan view of the range of motion limiting device of the present invention in an initial assembled position.
Figure 3A:
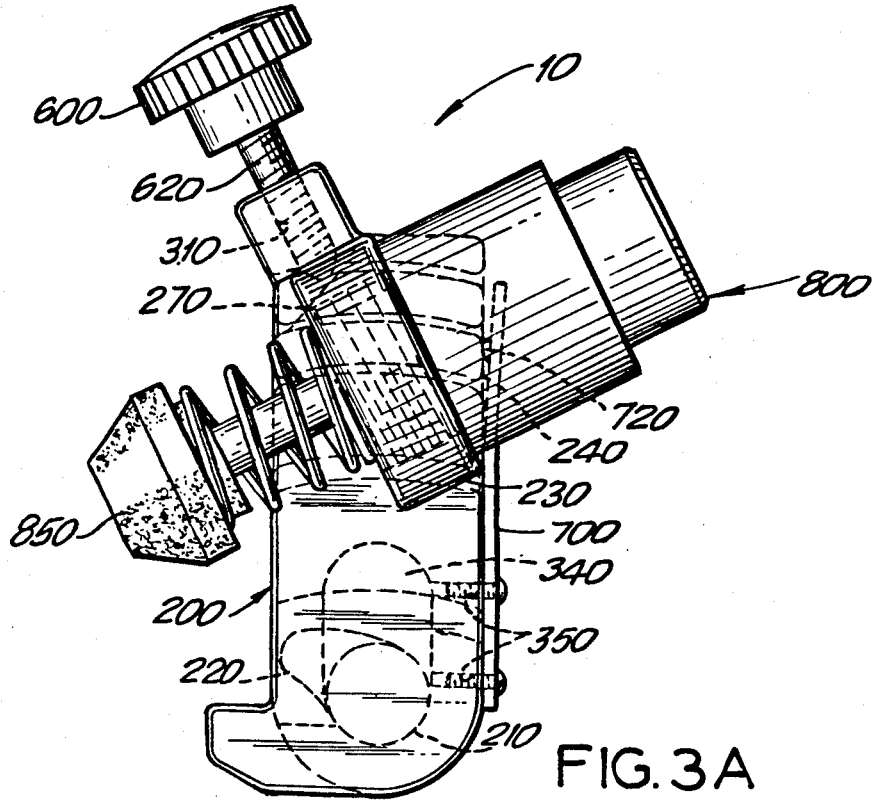
FIG. 3A a plan view of the range of motion limiting device of FIG. 3 in a final assembled position.
Figure 3B:
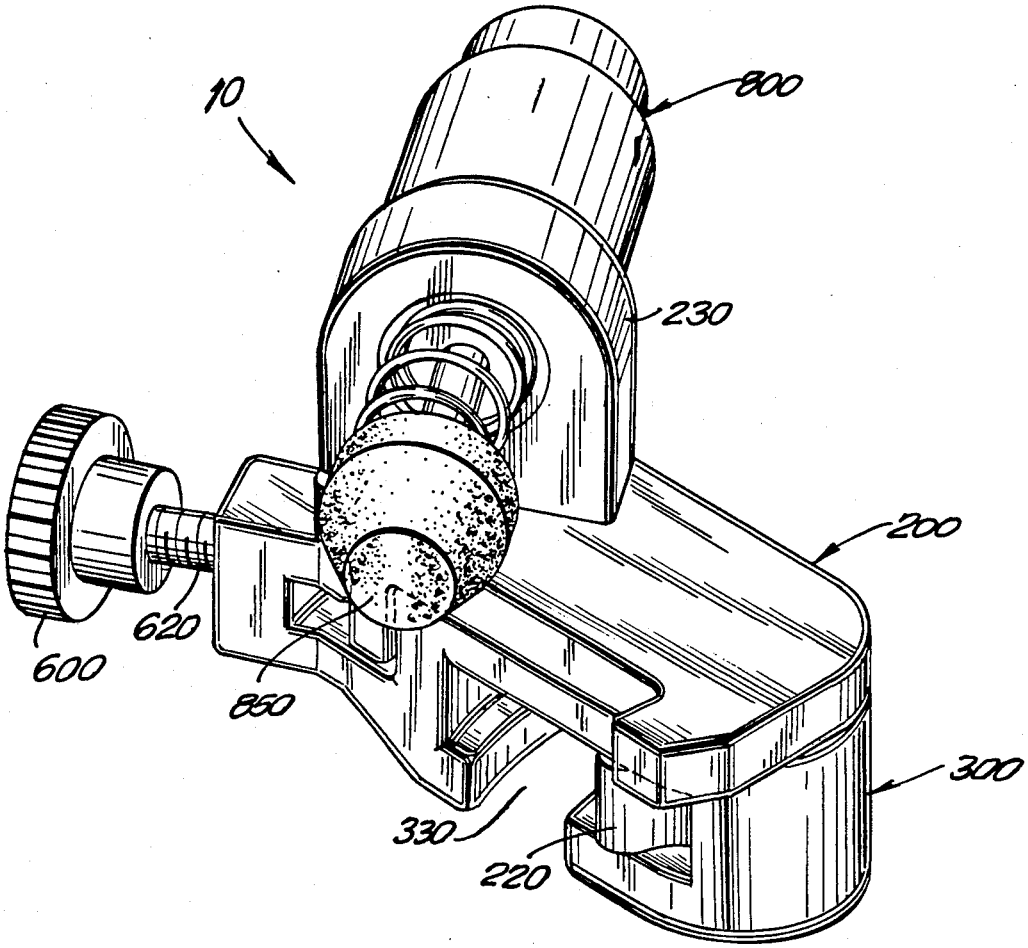
FIG. 3B a perspective view of the range of motion limiting device shown in FIG. 3A.

To complete the assembly of the range of motion limiting device 10, the cam lock 200, when in the position shown in FIG. 3, is rotated clockwise 90° relative to the cam lock housing 300 to the final assembled position shown in FIGS. 3A and 3B. The direction of rotation of the cam lock 200 is that shown by the arrow in FIG. 3. The tongue 240 of the cam lock will fit into the groove 320 of the cam lock housing 300 as the cam lock 200 is rotated.

The assembled range of motion limiting device 10 of FIG. 3A and 3B is then secured on the semi-circular ring 400. This is accomplished by sliding the range of motion limiting device 10 onto the end 420 of the semi-circular ring 400 as shown in FIG. 11. The ring clamp groove 330 of the cam lock housing 300 nests around the semi-circular ring 400, as previously described. The configuration of the ring clamp groove 330 at surfaces 338 and 339 insures that the range of motion limiting device 10 cannot be removed from the semi-circular ring except by sliding the device 10 off one of the ends 420 or 440 of the semi-circular ring 400.

In order to clamp the range of motion limiting device 10 securely to the circular ring 400 at the desired position, the locking knob 600 is screwed in. Integral to the locking knob 600 is the locking knob base 620 as shown in FIG. 3. Screwing in the locking knob 600 causes the locking knob base 620 to bear against an angled surface 270 of the cam lock 200. This forces the cam lock 200 to rotate clockwise relative to cam lock housing 300, in the direction of the arrow on FIG. 3A. The position of the locking knob base 620 in relation to the angled surface 270 of the cam lock is most easily seen in FIG. 3A.

As cam lock 200 rotates clockwise relative to cam lock housing 300 in response to the turning in of locking knob 600, the cam 220 of cam lock 200 also rotates clockwise relative to the cam lock housing 300 and bears against the inside diameter 430 of the semi-circular ring 400 as shown in FIG. 11. As the cam 220 pushes against the inside diameter 430 of the semi-circular ring 400, the outside diameter 460 of the semi-circular ring 400 is pressed against the carbarundum on the sheet metal shoe 331 attached to the surface 332 of the cam lock housing 300. The range of motion limiting device 10 is then held in place on the semi-circular ring 400 by the friction force between the cam 220 and the inside diameter 430 of the semi-circular ring 400 and the friction force between the outside diameter 460 of the semi-circular ring 400 and the carbarundum on the sheet metal shoe 331 attached to the surface 332 on the cam lock housing 300. Only a small force (screwing in locking knob 600) is needed to clamp the range of motion limiting device 10 securely to the semi-circular ring 400 at th desired position.

The range of motion limiting device 10 limits the motion of a rotary member, here the input assembly 20, in the following manner.

As the input arms **22*a* and 22*b* of the input assembly 20 rotate upwardly, i.e., the person in the machine 1 extends his or her trunk, the impact block 23 will hit an impact pad 850 on the shock absorber 800 at a certain point in the motion, depending on the positioning of the range of motion limiting device 10 on the semi-circular ring 400. When the impact block 23 strikes the impact pad 850 with a force in the direction shown by the arrow in FIG. 11, the cam lock 200 will attempt to rotate further in relation to the cam lock housing 300. However, since the cam 220 is already pressed against the inside diameter 430 of the semi-circular ring 400 as a result of the screwing in of locking knob 600, as previously described, the force from the impact block 23 impacting on the shock absorber 800 through the impact pad 850 will not cause much rotational movement but rather will cause the cam 220 to press harder against the inside diameter 430 of the semi-circular ring 400 as the cam 220 rotates a small amount against the inside diameter 430 of the semi-circular ring 400. This tightens the hold of the range of motion limiting device 10 on the semi-circular ring 400, stops the rotary motion of the input assembly 20, and insures that the person will not be able to extend the trunk any further. The friction characteristics of the range of motion limiting device 10 are such that the force from the impact block 23 on the shock absorber 800 through the impact pad 850 is amplified and always provides a gripping force on the semi-circular ring 400 greater than the force exerted by the impact block 23**.

Any suitable force absorbing means in addition to shock absorber 800 may be used in the present invention.

A second range of motion device 1000, shown in FIG. 12, is slid onto the end 440 of the semi-circular ring 400 and secured on the semi-circular ring 400 to provide a range of motion limitation on the input assembly 20 when the person engages in trunk flexion. The manner of securing the range of motion limiting device 1000 to the semi-circular ring 400 at the desired position is the same as that described for the range of motion limiting device 10, specifically, a locking knob 6000 is screwed in. The range of motion limiting device 1000 operates in the same fashion as the range of motion limiting device 10 described above. The configuration of the range of motion limiting device 10 is the mirror image of the range of motion limiting device 10, as can be generally seen in FIGS. 11 and 12.

The flat spring 700, which is mounted on the mountings 350 of the cam lock housing 300, is used to assist in disassembling the range of motion limiting device 10, i.e., separating the cam lock 200 from the cam lock housing 300.

Attached to the flat spring 700 is a button head screw 720 which extends into the groove 320 of the cam lock housing 300 when the range of motion limiting device is in the initial assembled position as shown in FIG. 3. When the cam lock 200 is rotated to the final assembled position shown in FIG. 3A, the flat spring 700, through the button head screw 720, will exert a force against the tongue 240 of the cam lock 200. When it is desired to move the range of motion limiting device 10 to a different location on the semi-circular ring 400, the locking knob 600 is first unscrewed and the cam lock 200 is rotated counterclockwise in relation to the cam lock housing, or in the rotational direction opposite to the direction of the arrow in FIG. 3A. The force from the spring 700 through button head screw 720 against tongue 240 aids in rotating the cam 220 away from the inside diameter 430 of the semi-circular ring 400. The range of motion limiting device may now be secured at a different position on the semi-circular ring 400. This procedure for changing the position of the range of motion limiting device can be easily and quickly made.

When the range of motion limiting device 10 is secured on the semi-circular ring 400 (i.e. the locking knob 600 is screwed in), the force from the locking knob base 620 against the angled surface 270 of the cam lock 200 prevents the force from the spring 700 from aiding in rotating the cam 220 away from the inside diameter of the semi-circular ring 400. It is not until the locking knob 600 is unscrewed that the force from the spring 700 aids in rotating the cam 220 away from the inside diameter of the semi-circular ring 400.

A dog point screw (not shown), secured by a nut to the flat spring 700, may be used in place of the button head screw 720. The dog point screw has the advantage that its position relative to the tongue 240 of the cam lock 200 can be adjusted by using the nut to secure the dog point screw to the flat spring 700 at the desired position.

For purposes of providing precise information on where the range of motion limiting device 10 is secured on the semi-circular ring 400, a pointer 290 attached to the cam lock 200 is used in conjunction with a position label 480 on the semi-circular ring 400. The pointer 290 and the position label 480 are shown in FIG. 11. The position label 480 and the pointer 290 allow the range of motion limiting device 10 to be secured at precise locations on the semi-circular ring 400, allowing for the repeatability of the test, rehabilitation or exercise procedure. A similar pointer and label are also used for the range of motion limiting device 1000.

The label 480 may alternatively by placed on a circular drum (not shown) which rotates on the same axis of rotation as the input arm 22*a*. In the embodiment utilizing the drum, the pointer 290 on the cam lock 200 is positioned to point to the label 480 on the drum, thus providing position information relative to the rotation of the input arm 22*a* rather than relative to the semi-circular ring 400.

It is readily seen that the range of motion limiting devices 10 and 1000 may be positioned anywhere on the semi-circular ring 400, thus providing an effective limitation on the range of rotary motion at any point in the range of motion. This positional adjustment is quickly and easily made. Also, only a small force (turning in locking knobs 600 and 6000) is required to secure the range of motion limiting devices 10 and 1000 on the semi-circular ring 400. Further, the range of motion limiting devices 10 and 1000 grab even more tightly against the semi-circular ring 400 when the impact block 23 strikes the impact pads 850 and 8500 of shock absorbers 800 and 8000, insuring that the rotary motion of the input assembly will be stopped at the point desired.

The range of motion limiting devices 10 and 1000 of the present invention may be used for limiting the range of motion of a rotating member other than in conjunction with a test, rehabilitation and exercise machine. Further, applicant's invention is not limited to the embodiment of the range of motion limiting device described above, but rather it is understood that applicant's invention is as set forth in the following claims.

I claim:

1. A range of motion limiting device positioned on a ring in combination with a rotating member comprising:

a cam lock having a cam base and a cam extending from the cam base;

a cam lock housing having an elongated hole for receiving the cam and the cam base, and a ring clamp groove for nesting around the ring;

means for rotating the cam lock in relation to the cam lock housing when the ring clamp groove is nested around the ring and the cam and the cam base are received in the elongated hole of the cam lock housing, wherein rotating the cam lock in relation to the cam lock housing causes the cam to rotate against an inside diameter of the ring securing the range of motion limiting device on the ring, and a force receiving element attached to the cam lock for receiving a force imparted by the rotating member whereby when a force is imparted by the rotating member against the force receiving element the cam further rotates against the inside diameter of the ring and the rotary motion of the rotating member is stopped.

2. The range of motion limiting device of claim 1 wherein the cam lock and cam lock housing are each one integral piece.

3. The range of motion limiting device of claim 1 wherein the cam lock also has a an L-shaped tongue and the cam lock housing has an L-shaped groove wherein the L-shaped tongue fits into the L-shaped groove after the cam and the cam base are received in the elongated hole of the cam lock housing.

4. The range of motion limiting device of claim 3 wherein the means for rotating the cam lock in relation to the cam lock housing when the ring clamp groove is nested around the ring comprises a locking knob turned in a thread in the cam lock housing wherein a locking knob base of the locking knob pushes against an angled surface on the L-shaped tongue of the cam lock causing the cam lock to rotate relative to the cam lock housing.

5. The range of motion limiting device of claim 3 also comprising a flat spring mounted on the cam lock housing for exerting a force against the L-shaped tongue of the cam lock to aid in separating the cam lock from the cam lock housing.

6. The range of motion limiting device of claim 1 wherein a surface of the ring clamp groove nesting against an outside diameter of the ring has a shoe rigidly secured thereto and a rough coating attached to the shoe.

7. The range of motion limiting device of claim 6 wherein the shoe is sheet metal and the rough coating is carbarundum flame sprayed on the sheet metal shoe.

8. The range of motion limiting device of claim 1 wherein the force receiving element comprises a shock absorber secured in a bracket on the cam lock wherein the rotating member imparts a force against the shock absorber which causes the cam to further rotate against the inside diameter of the ring.

9. The range of motion limiting device of claim 1 also comprising means for determining the position of the device in relation to the ring.

10. Apparatus for limiting the range of rotary motion of an input assembly on a test, rehabilitation or exercise machine comprising:

an input assembly rotatably mounted on a frame of the machine;

a ring fixedly mounted on the frame of the machine in a plane parallel to a plane of rotation of the input assembly;

a first range of motion limiting device positioned on the ring for limiting the range of rotary motion of the input assembly in a first rotational direction, said first range of motion limiting device comprising a cam lock having a cam base and a cam extending from the cam base;

a cam lock housing having an elongated hole for receiving the cam and the cam base, and a ring clamp groove for nesting around the ring;

means for rotating the cam lock in relation to the cam lock housing when the ring clamp groove is nested around the ring and the cam and the cam base are received in the elongated hole of the cam lock housing, wherein rotating the cam lock in relation to the cam lock housing causes the cam to rotate against an inside diameter of the ring securing the first range of motion limiting device on the ring;

a force receiving element attached to the cam lock for receiving a force imparted by the rotating member whereby when a force is imparted by the input assembly against the force receiving element said force is multiplied and the cam further rotates against the inside diameter of the ring and the rotary motion of the input assembly is stopped; and means for positioning the first device at any location on the ring.

11. The apparatus of claim 10 wherein the ring is semi-circular.

12. The apparatus of claim 10 wherein the cam lock and the cam lock housing are each one integral piece.

13. The apparatus of claim 10 wherein said cam lock also has a an L-shaped tongue and the cam lock housing has an L-shaped groove wherein the L-shaped tongue fits into the L-shaped groove after the cam and the cam base are received in the elongated hole of the cam lock housing.

14. The apparatus of claim 13 wherein the means for rotating the cam lock in relation to the cam lock housing when the ring clamp groove is nested around the ring comprises a locking knob turned in a thread in the cam lock housing wherein a locking knob base of the locking knob pushes against an angled surface on the L-shaped tongue of the cam lock causing the cam lock to rotate relative to the cam lock housing.

15. The apparatus of claim 13 also comprising a flat spring mounted on the cam lock housing for exerting a force against the L-shaped tongue of the cam lock to aid in separating the cam lock from the cam lock housing.

16. The apparatus of claim 10 wherein a surface of the ring clamp groove nesting against an outside diameter of the ring has a shoe rigidly secured thereto and a rough coating attached to the shoe.

17. The apparatus of claim 16 wherein the shoe is sheet metal and the rough coating is carbarundum flame sprayed on the sheet metal shoe.

18. The apparatus of claim 10 wherein the force receiving element comprises a shock absorber mounted in a bracket on the cam lock wherein the input assembly imparts a force against the shock absorber which causes the cam to further rotate against the inside diameter of the ring.

19. The apparatus of claim 10 also comprising means on the cam lock for positioning the range of motion limiting device at a precise location on the ring.

20. The apparatus of claim 10 also comprising a second range of motion limiting device positioned on the ring for limiting the range of rotary motion of the input assembly in a second rotational direction, said second range of motion limiting device configured in mirror image fashion to the first range of motion limiting device.

21. The apparatus of claim 20 also comprising means for positioning the second range of motion limiting device at any location of the ring.

* * * * *

UNITED STATES PATENT AND TRADEMARK OFFICE

CERTIFICATE OF CORRECTION

PATENT NO. : 4,753,126

DATED : June 28, 1988

INVENTOR(S) : Arthur Sammaratano

It is certified that error appears in the above—identified patent and that said Letters Patent is hereby corrected as shown below:

On the first page of the patent, the correct spelling of the inventor's name is as follows:

-- Arthur Sammartano --.

Signed and Sealed this

Ninth Day of May, 1989

*Attest:*

*Attesting Officer*

DONALD J. QUIGG

*Commissioner of Patents and Trademarks*